US009288599B2

(12) United States Patent
Ojanperä

(10) Patent No.: US 9,288,599 B2
(45) Date of Patent: Mar. 15, 2016

(54) AUDIO SCENE MAPPING APPARATUS

(75) Inventor: Juha Petteri Ojanperä, Nokia (FI)

(73) Assignee: Nokia Technologies Oy, Espoo (FI)

( * ) Notice: Subject to any disclaimer, the term of this patent is extended or adjusted under 35 U.S.C. 154(b) by 177 days.

(21) Appl. No.: 14/125,503

(22) PCT Filed: Jun. 17, 2011

(86) PCT No.: PCT/EP2011/060147

§ 371 (c)(1),
(2), (4) Date: Dec. 11, 2013

(87) PCT Pub. No.: WO2012/171584

PCT Pub. Date: Dec. 20, 2012

(65) Prior Publication Data

US 2014/0105406 A1 Apr. 17, 2014

(51) Int. Cl.
*H04R 29/00* (2006.01)
*H04R 3/00* (2006.01)

(52) U.S. Cl.
CPC ..... *H04R 29/005* (2013.01); *H04R 3/005* (2013.01)

(58) Field of Classification Search
CPC .... H04R 3/005; H04R 1/406; H04R 2499/11; H04R 1/08; H04R 2430/20; H04R 2430/23; H04R 5/027; H04R 2201/401
USPC ..... 381/92
See application file for complete search history.

(56) References Cited

U.S. PATENT DOCUMENTS

2010/0008515 A1* 1/2010 Fulton et al. ..... 381/92

FOREIGN PATENT DOCUMENTS

| | | |
|---|---|---|
| WO | 2009109217 | 9/2009 |
| WO | 2010052365 | 5/2010 |
| WO | 2011064438 | 6/2011 |

OTHER PUBLICATIONS

International Search Report received for corresponding Patent Cooperation Treaty Application No. PCT/EP2011/060147, dated Mar. 15, 2012, 4 pages.

* cited by examiner

*Primary Examiner* — Mark Blouin
(74) *Attorney, Agent, or Firm* — Nokia Technologies Oy

(57) ABSTRACT

An apparatus comprising: a receiver configured to receive at least one audio signal from a recording apparatus; the receiver further configured to receive at least one orientation indicator from the recording apparatus, each orientation indicator associated with one at least audio signal; a recording direction determiner configured to determine a recording orientation of the recording apparatus dependent on the at least one audio signal; a relative distance determiner configured to determining a relative distance of the recording apparatus from a sound source dependent on the at least one audio signal; and a relative position determiner configured to determining a relative position of the recording apparatus dependent on the orientation indicator and relative distance.

18 Claims, 13 Drawing Sheets

AUDIO SCENE MAPPING APPARATUS

RELATED APPLICATION

This application was originally filed as PCT Application No. PCT/EP2011/060147 filed Jun. 17, 2011.

FIELD OF THE APPLICATION

The present application relates to apparatus for the processing of audio and additionally video signals. The invention further relates to, but is not limited to, apparatus for processing audio and additionally video signals from mobile devices.

BACKGROUND OF THE APPLICATION

Viewing recorded or streamed audio-video or audio content is well known. Commercial broadcasters covering an event often have more than one recording device (video-camera/microphone) and a programme director will select a 'mix' where an output from a recording device or combination of recording devices is selected for transmission.

Multiple 'feeds' may be found in sharing services for video and audio signals (such as those employed by YouTube). Such systems, which are known and are widely used to share user generated content recorded and uploaded or up-streamed to a server and then downloaded or down-streamed to a viewing/listening user. Such systems rely on users recording and uploading or up-streaming a recording of an event using the recording facilities at hand to the user. This may typically be in the form of the camera and microphone arrangement of a mobile device such as a mobile phone.

Often the event is attended and recorded from more than one position by different recording users at the same time. The viewing/listening end user may then select one of the up-streamed or uploaded data to view or listen.

Where there is multiple user generated content for the same event it can be possible to generate an improved content rendering of the event by combining various different recordings from different users or improve upon user generated content from a single source, for example reducing background noise by mixing different users content to attempt to overcome local interference, or uploading errors.

SUMMARY OF THE APPLICATION

Aspects of this application thus provide an audio source classification process whereby multiple devices can be present and recording audio signals and a server can classify and select from these audio sources suitable signals from the uploaded data.

There is provided according to the application an apparatus comprising at least one processor and at least one memory including computer code for one or more programs, the at least one memory and the computer code configured to with the at least one processor cause the apparatus to at least perform: receiving at least one audio signal from a recording apparatus; receiving at least one orientation indicator from the recording apparatus, each orientation indicator associated with one at least audio signal; determining a recording orientation of the recording apparatus dependent on the at least one audio signal; determining a relative distance of the recording apparatus from a sound source dependent on the at least one audio signal; and determining a relative position of the recording apparatus dependent on the orientation indicator and relative distance.

The at least one orientation indicator may comprise at least one of: a compass indicator signal; a gyroscope indicator signal; and a satellite position indicator signal.

Determining a relative distance of the recording apparatus from a sound source dependent on the at least one audio signal may cause the apparatus to at least perform: determining an average audio signal level for at least two recording apparatus; and mapping each of the at least audio signal to a relative distance dependent on a signal level of the at least one audio signal compared against the average audio signal level.

Determining a recording orientation of the recording apparatus dependent on the at least one audio signal may cause the apparatus to at least perform: determining an energy spectrum for each audio signal; and determining the recording orientation dependent on the energy spectrum and the orientation indicator.

The apparatus may be further caused to perform: selecting at least one of the at least one audio signal dependent on at least one of: the recording orientation of the recording apparatus; the relative distance of the recording apparatus; and the relative position of the recording apparatus.

The apparatus may be further caused to perform processing each of the at least one of the at least one audio signal selected dependent on at least one of: the recording orientation of the recording apparatus; the relative distance of the recording apparatus; and the relative position of the recording apparatus.

Processing each of the at least one of the at least one audio signals selected may further cause the apparatus to perform at least one of: filtering each of the at least one of the at least one audio signal selected; mixing each of the at least one of the at least one audio signal selected; and blending each of the at least one of the at least one audio signal selected.

The apparatus may be further caused to perform outputting each of the at least one of the at least one audio signal selected to a further apparatus.

The apparatus may be further caused to perform: receiving a selection indicator from a further apparatus; and wherein selecting at least one of the at least one audio signal is further dependent on the selection indicator.

According to a second aspect there is provided a method comprising: receiving at least one audio signal from a recording apparatus; receiving at least one orientation indicator from the recording apparatus, each orientation indicator associated with one at least audio signal; determining a recording orientation of the recording apparatus dependent on the at least one audio signal; determining a relative distance of the recording apparatus from a sound source dependent on the at least one audio signal; and determining a relative position of the recording apparatus dependent on the orientation indicator and relative distance.

The at least one orientation indicator may comprise at least one of: a compass indicator signal; a gyroscope indicator signal; and a satellite position indicator signal.

Determining a relative distance of the recording apparatus from a sound source dependent on the at least one audio signal may comprise: determining an average audio signal level for at least two recording apparatus; and mapping each of the at least audio signal to a relative distance dependent on a signal level of the at least one audio signal compared against the average audio signal level.

Determining a recording orientation of the recording apparatus dependent on the at least one audio signal may comprise: determining an energy spectrum for each audio signal; and determining the recording orientation dependent on the energy spectrum and the orientation indicator.

The method may further comprise: selecting at least one of the at least one audio signal dependent on at least one of: the recording orientation of the recording apparatus; the relative distance of the recording apparatus; and the relative position of the recording apparatus.

The method may further comprise processing each of the at least one of the at least one audio signals selected dependent on at least one of: the recording orientation of the recording apparatus; the relative distance of the recording apparatus; and the relative position of the recording apparatus.

Processing each of the at least one of the at least one audio signals selected may comprise at least one of: filtering each of the at least one of the at least one audio signal selected; mixing each of the at least one of the at least one audio signal selected; and blending each of the at least one of the at least one audio signal selected.

The method may further comprise outputting each of the at least one of the at least one audio signal selected to a further apparatus.

The method may further comprise: receiving a selection indicator from a further apparatus; and wherein selecting at least one of the at least one audio signal is further dependent on the selection indicator.

According to a third aspect there is provided an apparatus comprising: means for receiving at least one audio signal from a recording apparatus; means for receiving at least one orientation indicator from the recording apparatus, each orientation indicator associated with one at least audio signal; means for determining a recording orientation of the recording apparatus dependent on the at least one audio signal; means for determining a relative distance of the recording apparatus from a sound source dependent on the at least one audio signal; and means for determining a relative position of the recording apparatus dependent on the orientation indicator and relative distance.

The at least one orientation indicator may comprise at least one of: a compass indicator signal; a gyroscope indicator signal; and a satellite position indicator signal.

The means for determining a relative distance of the recording apparatus from a sound source dependent on the at least one audio signal may comprise: means for determining an average audio signal level for at least two recording apparatus; and means for mapping each of the at least audio signal to a relative distance dependent on a signal level of the at least one audio signal compared against the average audio signal level.

The means for determining a recording orientation of the recording apparatus dependent on the at least one audio signal may comprise: means for determining an energy spectrum for each audio signal; and means for determining the recording orientation dependent on the energy spectrum and the orientation indicator.

The apparatus may further comprise: means for selecting at least one of the at least one audio signal dependent on at least one of: the recording orientation of the recording apparatus; the relative distance of the recording apparatus; and the relative position of the recording apparatus.

The apparatus may further comprise means for processing each of the at least one of the at least one audio signal selected dependent on at least one of: the recording orientation of the recording apparatus; the relative distance of the recording apparatus; and the relative position of the recording apparatus.

The means for processing each of the at least one of the at least one audio signals selected may further comprise at least one of: means for filtering each of the at least one of the at least one audio signal selected; means for mixing each of the at least one of the at least one audio signals selected; and means for blending each of the at least one of the at least one audio signal selected.

The apparatus may further comprise means for outputting each of the at least one of the at least one audio signal selected to a further apparatus.

The apparatus may further comprise: means for receiving a selection indicator from a further apparatus; and wherein the means for selecting at least one of the at least one audio signal is further dependent on the selection indicator.

According to a fourth aspect there is provided an apparatus comprising: a receiver configured to receive at least one audio signal from a recording apparatus; the receiver further configured to receive at least one orientation indicator from the recording apparatus, each orientation indicator associated with one at least audio signal; a recording direction determiner configured to determine a recording orientation of the recording apparatus dependent on the at least one audio signal; a relative distance determiner configured to determining a relative distance of the recording apparatus from a sound source dependent on the at least one audio signal; and a relative position determiner configured to determining a relative position of the recording apparatus dependent on the orientation indicator and relative distance.

The at least one orientation indicator may comprise at least one of: a compass indicator signal; a gyroscope indicator signal; and a satellite position indicator signal.

The relative distance determiner may comprise: a signal average configured to determine an average audio signal level for at least two recording apparatus; and a signal mapper configured to map each of the at least one audio signal to a relative distance dependent on a signal level of the at least one audio signal compared against the average audio signal level.

The recording direction determiner may comprise: an energy determiner configured to determine an energy spectrum for each audio signal; and a direction determiner configured to determine the recording orientation dependent on the energy spectrum and the orientation indicator.

The apparatus may further comprise: a selector configured to select at least one of the at least one audio signal dependent on at least one of: the recording orientation of the recording apparatus; the relative distance of the recording apparatus; and the relative position of the recording apparatus.

The apparatus may further comprise a digital signal processor configured to process each of the at least one of the at least one audio signal selected dependent on at least one of: the recording orientation of the recording apparatus; the relative distance of the recording apparatus; and the relative position of the recording apparatus.

The digital signal processor may comprise at least one of: a filter configured to filter each of the at least one of the at least one audio signal selected; and a mixer configured to mix each of the at least one of the at least one audio signal selected; and a blender configured to blend each of the at least one of the at least one audio signals selected.

The apparatus may further comprise an output configured to output each of the at least one of the at least one audio signal selected to a further apparatus.

The apparatus may further comprise: the receiver configured to receive a selection indicator from a further apparatus; and wherein the selector is configured to select at least one of the at least one audio signal is further dependent on the selection indicator.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS OF THE APPLICATION

The following describes in further detail suitable apparatus and possible mechanisms for the provision of effective audio scene mapping and furthermore selection. In the following examples audio signals and audio capture uploading and downloading is described. However it would be appreciated that in some embodiments the audio signal/audio capture, uploading and downloading is one part of an audio-video system.

The concept of the application is an attempt to improve on a selection criteria which can have a poor typical accuracy. For example using satellite (also known as global positioning system GPS) positioning, it can be possible to locate a device to within a region of between 1 to 15 meters. In some embodiments as described herein by improving the localisation for each recording source using the satellite information received at each recording device an improved position or localisation in the selected listening point can be generated. Furthermore the application attempts to improve performance for operation in indoor or poor satellite signal areas which further can complicate the localisation of recording sources. Furthermore, aspects of the application attempt to provide a functionality where information concerning the relative positions of the recording sources can be made available in such a way that they enable different audio scene compositions to be created and offered for an end user or for an application used by the end user.

Thus the application concept in some embodiments is to provide a "map of shooters" method for multi-user recordings to be performed. In other words in remote listening and/or viewing, embodiments of the application enable individually recorded content to be combined and associated sensor information to be presented as a "map of shooters" describing the recorded audio visual scene. This can, for example, in some embodiments of the application be described as a four-step process whereby the first step is the operation of calculating the recording angle (or azimuth) of the recording sources, the second step being the operation of calculating sound source directions for the scene, the third step being the operation of determining virtual positions of the recording sources, and the fourth step being the operation of selecting recording sources to be consumed based on the direction, azimuth and virtual position.

Figure 1:
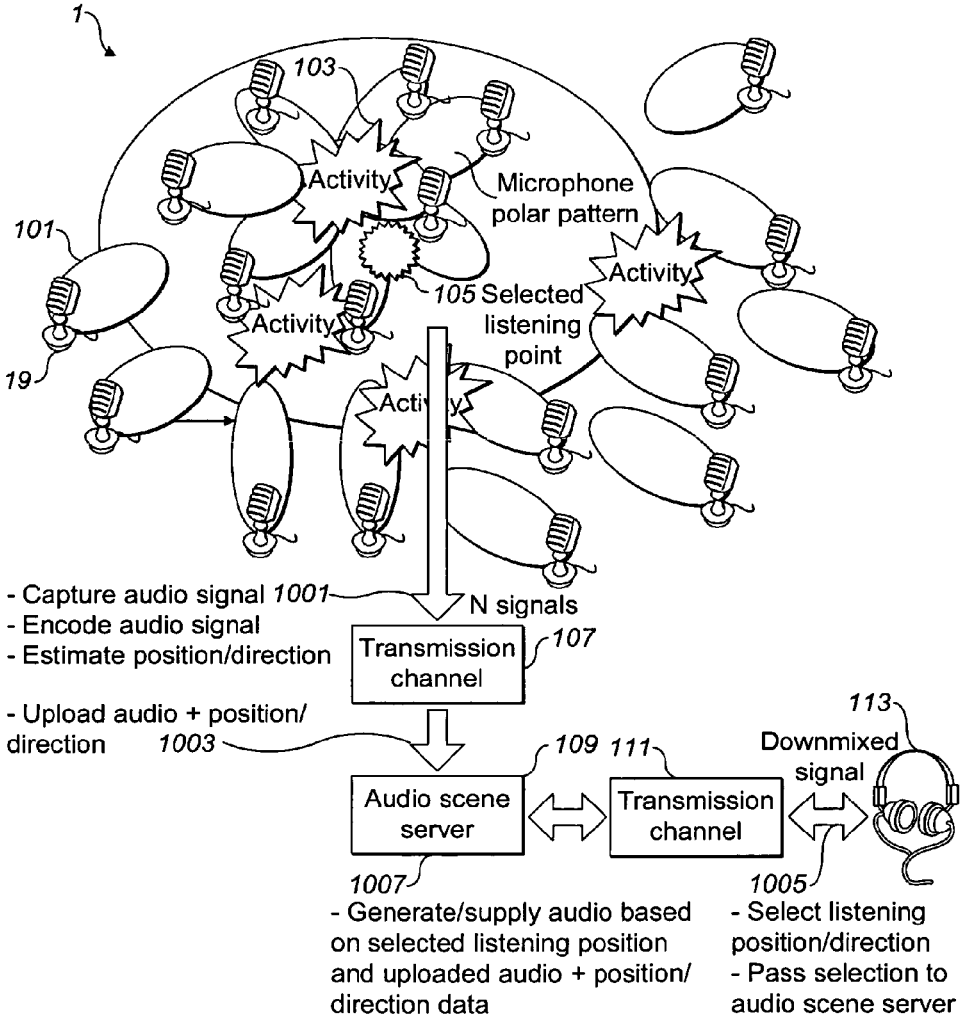
FIG. 1 shows schematically a multi-user free-viewpoint service sharing system which may encompass embodiments of the application.

With respect to FIG. 1 an overview of a suitable system within which embodiments of the application can be located is shown. The audio space 1 can have located within it at least one recording or capturing devices or apparatus 19 which are arbitrarily positioned within the audio space to record suitable audio scenes. The apparatus shown in FIG. 1 are represented as microphones with a polar gain pattern 101 showing the directional audio capture gain associated with each apparatus. The apparatus 19 in FIG. 1 are shown such that some of the apparatus are capable of attempting to capture the audio scene or activity 103 within the audio space. The activity 103 can be any event the user of the apparatus wishes to capture. For example the event could be a music event or audio of a news worthy event. The apparatus 19 although being shown having a directional microphone gain pattern 101 would be appreciated that in some embodiments the microphone or microphone array of the recording apparatus 19 has a omnidirectional gain or different gain profile to that shown in FIG. 1.

Each recording apparatus 19 can in some embodiments transmit or alternatively store for later consumption the captured audio signals via a transmission channel 107 to an audio scene server 109. The recording apparatus 19 in some embodiments can encode the audio signal to compress the audio signal in a known way in order to reduce the bandwidth required in "uploading" the audio signal to the audio scene server 109.

The recording apparatus 19 in some embodiments can be configured to estimate and upload via the transmission channel 107 to the audio scene server 109 an estimation of the location and/or the orientation or direction of the apparatus. The position information can be obtained, for example, using GPS coordinates, cell-ID or a-GPS or any other suitable location estimation methods and the orientation/direction can be obtained, for example using a digital compass, accelerometer, or gyroscope information.

In some embodiments the recording apparatus 19 can be configured to capture or record one or more audio signals for example the apparatus in some embodiments have multiple microphones each configured to capture the audio signal from different directions. In such embodiments the recording device or apparatus 19 can record and provide more than one signal from different the direction/orientations and further supply position/direction information for each signal. With respect to the application described herein an audio or sound source can be defined as each of the captured or audio recorded signal. In some embodiments each audio source can be defined as having a position or location which can be an absolute or relative value. For example in some embodiments the audio source can be defined as having a position relative to a desired listening location or position. Furthermore in some embodiments the audio source can be defined as having an orientation, for example where the audio source is a beamformed processed combination of multiple microphones in the recording apparatus, or a directional microphone. In some embodiments the orientation may have both a directionality and a range, for example defining the 3 dB gain range of a directional microphone.

The capturing and encoding of the audio signal and the estimation of the position/direction of the apparatus is shown in FIG. 1 by step 1001.

The uploading of the audio and position/direction estimate to the audio scene server 109 is shown in FIG. 1 by step 1003.

The audio scene server 109 furthermore can in some embodiments communicate via a further transmission channel 111 to a listening device 113.

In some embodiments the listening device 113, which is represented in FIG. 1 by a set of headphones, can prior to or during downloading via the further transmission channel 111 select a listening point, in other words select a position such as indicated in FIG. 1 by the selected listening point 105. In such embodiments the listening device 113 can communicate via the further transmission channel 111 to the audio scene server 109 the request.

The selection of a listening position by the listening device 113 is shown in FIG. 1 by step 1005.

The audio scene server 109 can as discussed above in some embodiments receive from each of the recording apparatus 19 an approximation or estimation of the location and/or direction of the recording apparatus 19. The audio scene server 109 can in some embodiments from the various captured audio signals from recording apparatus 19 produce a composite audio signal representing the desired listening position and the composite audio signal can be passed via the further transmission channel 111 to the listening device 113.

The generation or supply of a suitable audio signal based on the selected listening position indicator is shown in FIG. 1 by step 1007.

In some embodiments the listening device 113 can request a multiple channel audio signal or a mono-channel audio signal. This request can in some embodiments be received by the audio scene server 109 which can generate the requested multiple channel data.

The audio scene server 109 in some embodiments can receive each uploaded audio signal and can keep track of the positions and the associated direction/orientation associated with each audio source. In some embodiments the audio scene server 109 can provide a high level coordinate system which corresponds to locations where the uploaded/upstreamed content source is available to the listening device 113. The "high level" coordinates can be provided for example as a map to the listening device 113 for selection of the listening position. The listening device (end user or an application used by the end user) can in such embodiments be responsible for determining or selecting the listening position and sending this information to the audio scene server 109. The audio scene server 109 can in some embodiments receive the selection/determination and transmit the downmixed signal corresponding to the specified location to the listening device. In some embodiments the listening device/end user can be configured to select or determine other aspects of the desired audio signal, for example signal quality, number of channels of audio desired, etc. In some embodiments the audio scene server 109 can provide in some embodiments a selected set of downmixed signals which correspond to listening points neighbouring the desired location/direction and the listening device 113 selects the audio signal desired.

Figure 2:
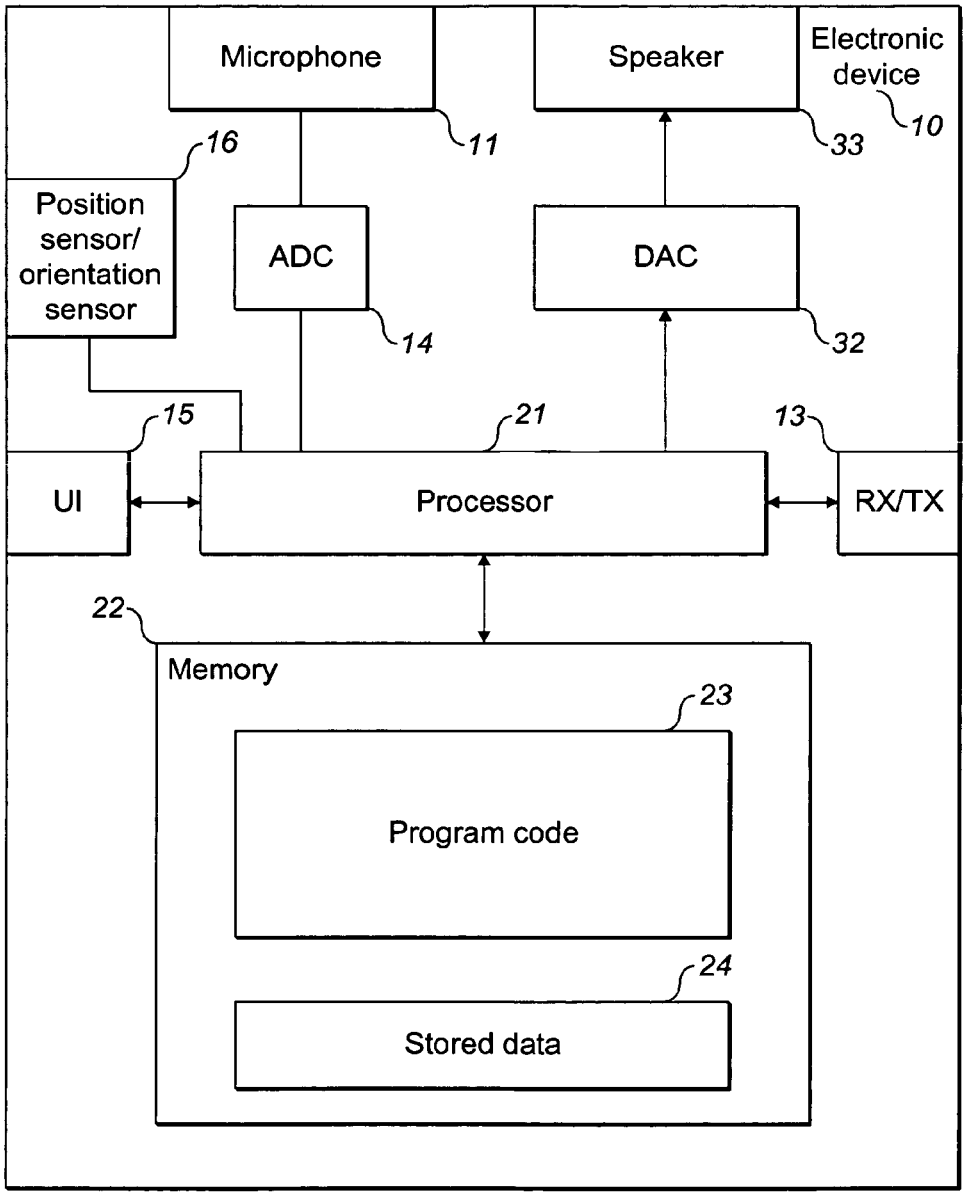
FIG. 2 shows schematically an apparatus suitable for being employed in embodiments of the application.

In this regard reference is first made to FIG. 2 which shows a schematic block diagram of an exemplary apparatus or electronic device 10, which may be used to record (or operate as a recording device 19) or listen (or operate as a listening device 113) to the audio signals (and similarly to record or view the audio-visual images and data). Furthermore in some embodiments the apparatus or electronic device can function as the audio scene server 109.

The electronic device 10 may for example be a mobile terminal or user equipment of a wireless communication system when functioning as the recording device or listening device 113. In some embodiments the apparatus can be an audio player or audio recorder, such as an MP3 player, a media recorder/player (also known as an MP4 player), or any suitable portable device suitable for recording audio or audio/video camcorder/memory audio or video recorder.

The apparatus 10 can in some embodiments comprise an audio subsystem. The audio subsystem for example can comprise in some embodiments a microphone or array of microphones 11 for audio signal capture. In some embodiments the microphone or array of microphones can be a solid state microphone, in other words capable of capturing audio signals and outputting a suitable digital format signal. In some other embodiments the microphone or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means.

In some embodiments the apparatus 10 audio subsystem further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can comprise in some embodiments a speaker 33. The speaker 33 can in some embodiments receive the output from the digital-to-analogue converter 32 and present the analogue audio signal to the user. In some embodiments the speaker 33 can be representative of a headset, for example a set of headphones, or cordless headphones.

Although the apparatus 10 is shown having both audio capture and audio presentation components, it would be understood that in some embodiments the apparatus 10 can comprise one or the other of the audio capture and audio presentation parts of the audio subsystem such that in some embodiments of the apparatus the microphone (for audio capture) or the speaker (for audio presentation) are present.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals. The processor 21 can be configured to execute various program codes. The implemented program codes can comprise for example audio encoding code routines.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been encoded in accordance with the application or data to be encoded via the application embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The coupling can, as shown in FIG. 1, be the transmission channel 107 (where the apparatus is functioning as the recording device 19 or audio scene server 109) or further transmission channel 111 (where the device is functioning as the listening device 113 or audio scene server 109). The transceiver 13 can communicate with further devices by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, a gyroscope or be determined by the motion of the apparatus using the positioning estimate.

It is to be understood again that the structure of the electronic device 10 could be supplemented and varied in many ways.

Furthermore it could be understood that the above apparatus 10 in some embodiments can be operated as an audio scene server 109. In some further embodiments the audio scene server 109 can comprise a processor, memory and transceiver combination.

Figure 3:
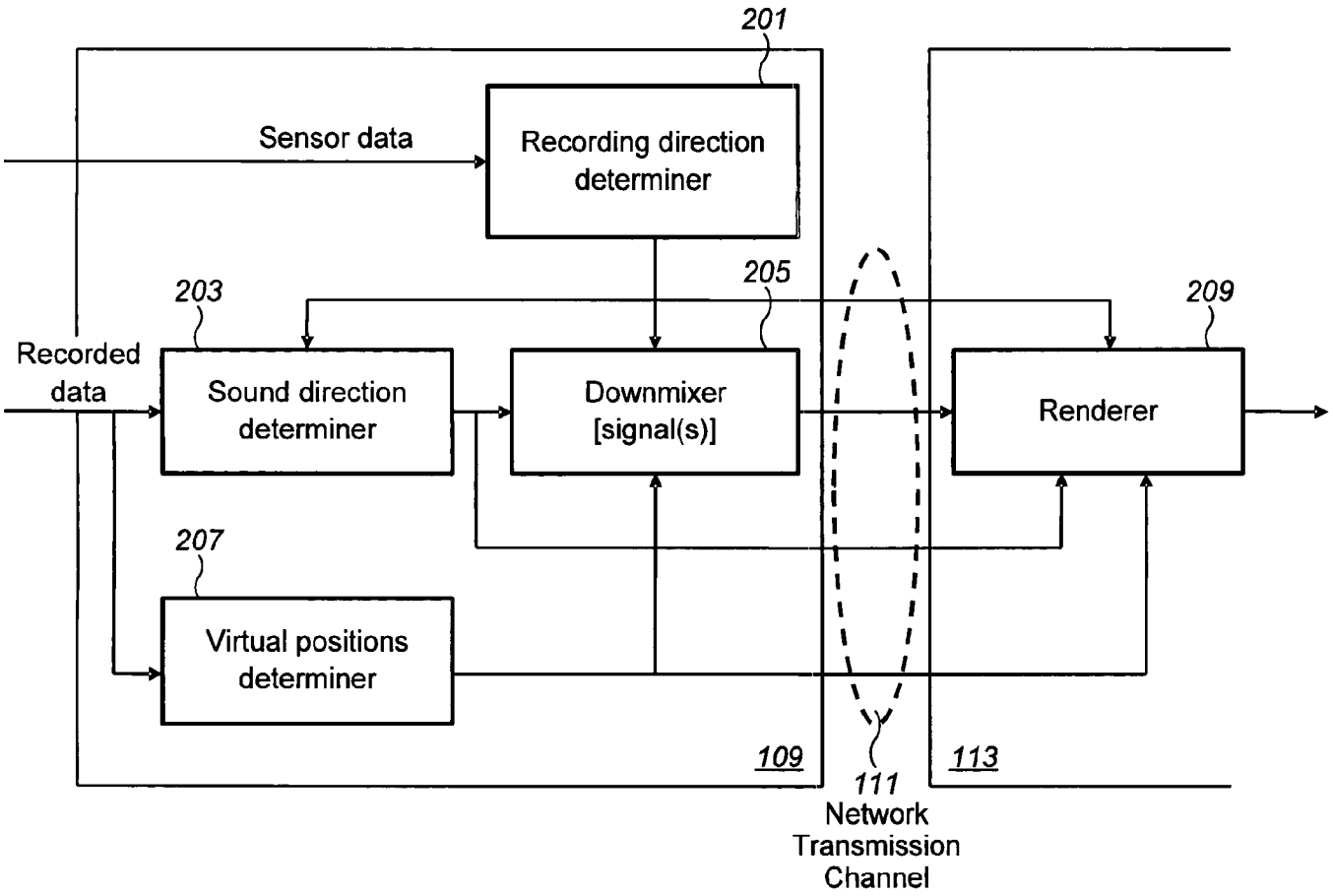
FIG. 3 shows schematically an audio scene mapping system according to some embodiments of the application.

With respect to FIG. 3 an overview of the application according to some embodiments is shown with respect to the audio scene server 109 and listening device 113. Furthermore the operation of the audio scene server 109 according to some embodiments is shown with respect to FIG. 8.

As described herein, the audio scene server 109 is configured to receive the various recording capture or audio scene capture 19 sources with their uploaded audio signals. This is shown with respect to FIG. 3 by the input to the audio scene server 109 of the sensor data from the capture sources and the recorded data or audio data from the capture or recording device sources. In some embodiments the audio signals and/or capture device (recording apparatus) orientation indicators can be received at some means for receiving such as a receiver, or receiver portion of a transceiver.

Figure 8:
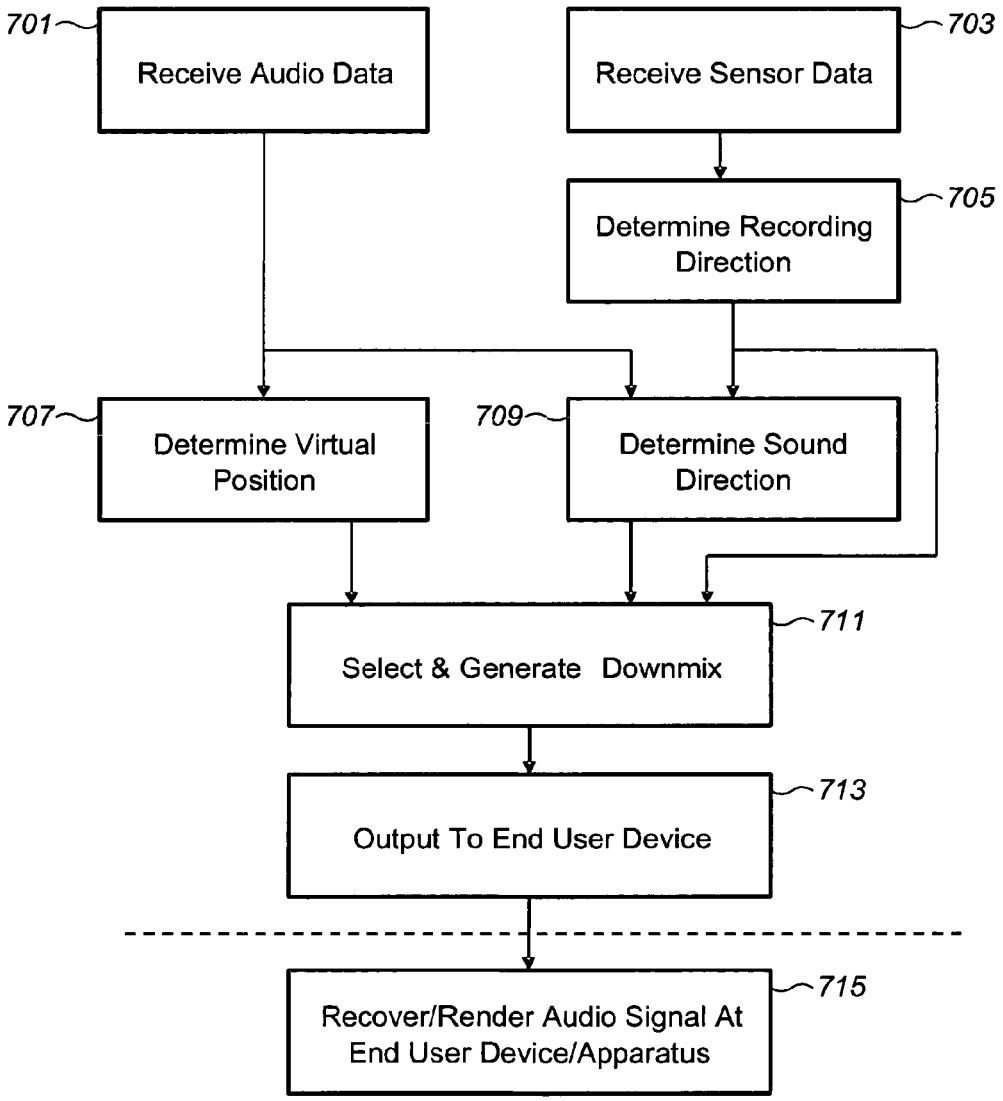
FIG. 8 shows a flow diagram of the operation of the audio mapping system, as shown in FIG. 3.

The operation of receiving the audio data is shown in FIG. 8 by step 701.

The operation of receiving the sensor data is shown also in FIG. 8 by step 703.

In some embodiments the audio scene server 109 can comprise a recording direction determiner 201, or means for determining a recording orientation of the recording apparatus, which is configured to receive the sensor data from the capture devices. The recording direction determiner 201 can be configured to determine the recording direction of each capture device using the information provided from the capture device sensors such as compass sensor data. The output of the recording direction determiner 201 can be passed to the sound direction determiner 203, the down mixer 205, and furthermore to the end user or listening device 113 and in some embodiments the renderer 209 associated with the listening device 113.

The operation of determining the recording direction is shown in FIG. 8 by step 705.

In some embodiments the audio scene server 109 can comprise a sound direction determiner 203. The sound direction determiner 203 can be configured to determine the sound direction of the scene using the recorded audio data from the capture devices combined with the information of the recording angle or direction from the recording direction determiner 201. The sound direction determiner 203 can furthermore be configured to output the sound of direction values to the down mixer 205 and furthermore to the listening device 113 and specifically in some embodiments the renderer 209 of the listening device 113.

The operation of determining the sound direction can be seen in FIG. 8 by step 709.

In some embodiments the audio scene server 109 can be configured to receive the recorded audio data from the capture devices and further be configured to determine the virtual positions of the capture devices and map these onto the positioning values. The output of the determined virtual positions can be passed to the down mixer 205 and further to the listening device renderer 209. In some embodiments the virtual position determination can be performed by a means for determining a relative distance of the recording apparatus from a sound source dependent on the at least one audio signal and furthermore using means for determining a relative position of the recording apparatus dependent on the orientation indicator and relative distance.

The operation of determining the virtual position of the sources is shown in FIG. 8 by step 707.

In some embodiments the audio scene server 109 can comprise a down mixer 205. The down mixer 205 can be configured to receive the recording direction, sound direction and virtual position of the capture devices together with a selection for a specified position from the listening device. The selection performed by the down mixer 205 thus can use the "map of shooters" information in the preparation for the composition of the audio sources used in the down mixing operation.

Furthermore the operation of selecting and generating the down mix is shown in FIG. 8 by step 711.

In some embodiments the down mixer 205 can be configured to use the selected audio sources to generate a signal suitable for transmitting on the transmission channel 111 to the listening device. For example in some embodiments the down mixer 205 can receive multiple audio source signals, and dependent on the source data, recording direction, sound direction and virtual position of the capture devices select and generate a multi-channel or single (mono) channel simulating the effect of being at the desired listening position and in a format suitable for listening to by the listening device 113. For example where the listening device is a stereo headset, the down mixer 205 can be configured to generate a suitable stereo signal.

The operation of outputting to the listening device 113 or end user device a suitable signal is shown in FIG. 8 by step 713.

Furthermore in some embodiments the listening device 113 can comprise a renderer 209. The renderer 209 can be configured to receive the down mixed output signal via the transmission channel 111 and generate a rendered signal suitable for the listening device 113 end user. For example in some embodiments, the renderer 209 can be configured to decode the encoded audio signal output by the down mixer 205 in a format suitable for presentation to a stereo headset or headphones or speakers.

Figure 4:
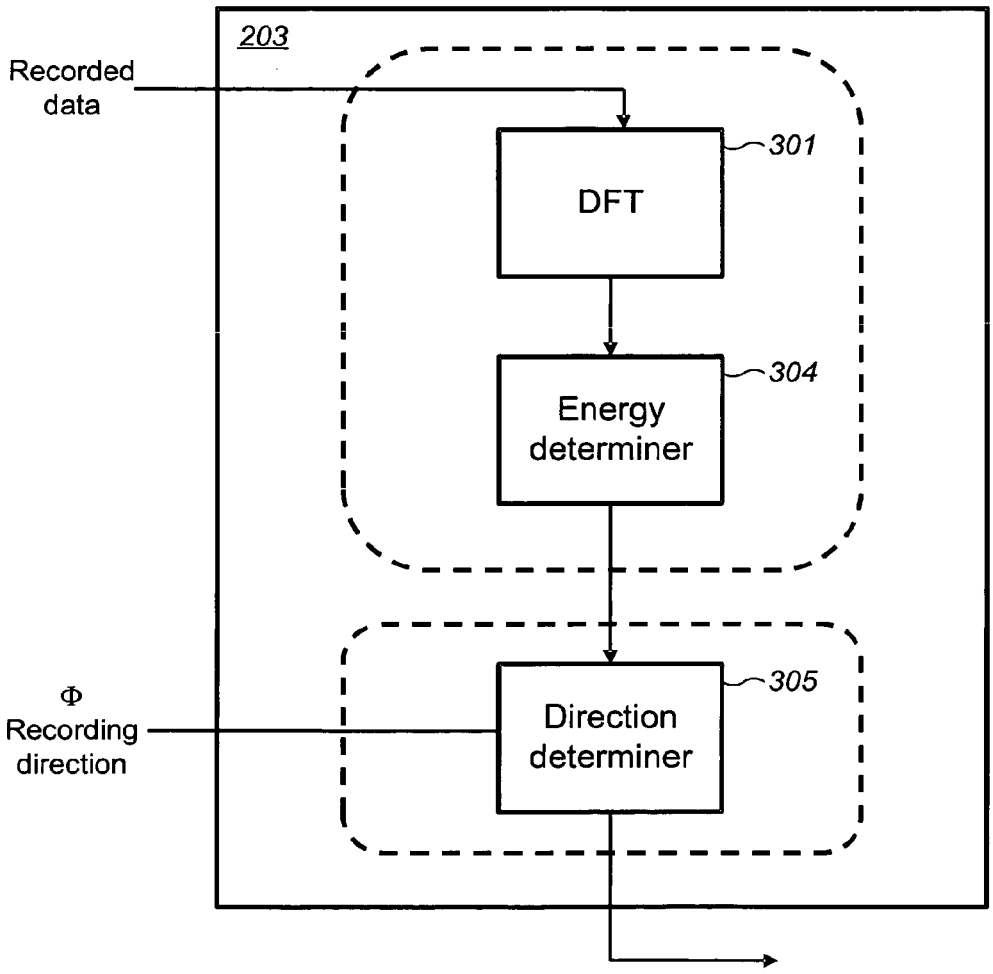
FIG. 4 shows schematically a sound direction determiner as shown in FIG. 3 according to some embodiments of the application.

With respect to FIG. 4, the sound direction determiner is shown in further detail. Furthermore with respect to FIG. 9 the operation of the sound direction determiner as employed in embodiments of the application is further shown.

In some embodiments the sound direction determiner 203 can be configured to receive the recorded data from the various audio sources or capture devices.

Figure 9:
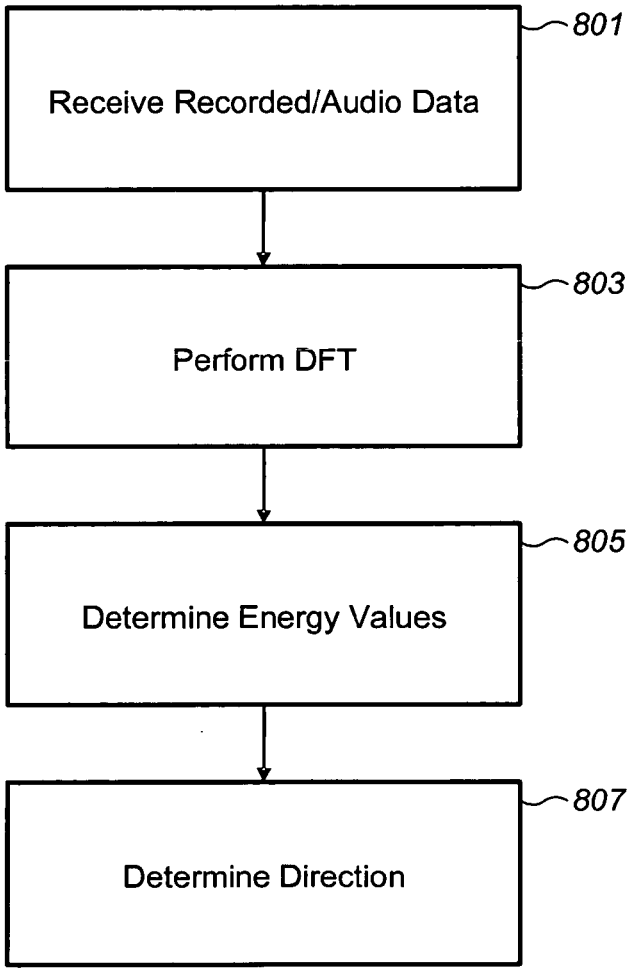
FIG. 9 shows a flow diagram of the operation of the sound direction determiner as shown in FIG. 4 according to some embodiments of the application.

The reception of the recorded/audio data is shown in FIG. 9 by step 801.

Furthermore in some embodiments the sound direction determiner 203 can comprise a Discrete Fourier Transformer 301. The Discrete Fourier Transformer can be configured to transform a time domain representation of the capture device or recording source signal $X_m$, where m represents the device or source reference into a frequency domain representation. In some embodiments of the application the transformation can be represented by the following equation:

$$X_m[bin,l]=TF(x_{m,bin,l,T})$$

where m is the recording source index, bin is the frequency bin index, l is time frame index, T is the hop size between successive segments, and TF( ) the time-to-frequency operator. In the current implementation, a Discrete Fourier Transform (DFT) is used as the TF operator as follows $$TF(x_{m,bin,l,T}) = \sum_{n=0}^{N-1} (\mathrm{win}(n) \cdot x_m(n + l \cdot T) \cdot e^{-j w_{bin} \cdot n})$$

where $$w_{bin} = \frac{2 \cdot \pi \cdot \mathrm{bin}}{N},$$

win(n) is a N-point analysis window, such as sinusoidal, Hanning, Hamming, Welch, Bartlett, Kaiser or Kaiser-Bessel Derived (KBD) window. To obtain continuity and smooth Fourier coefficients over time, the hop size is set to T=N/2, that is, the previous and current signal segments are 50% overlapping.

The transformation applied by the Discrete Fourier Transformer 301 can be determined on a frame-by-frame basis where the size of a frame is of a determined short duration. For example in some embodiments the frame duration is less than 50 milliseconds, for example 20 milliseconds. In some embodiments the Discrete Fourier Transformer 301 can be replaced by any suitable time-to-frequency domain transformer such as a Cosine or Sine Transformer such as a Modified Discrete Cosine Transformer (MDCT), a Modified Discrete Sine Transformer (MDST), a Quadrature Mirror Filter (QMF), or a Complex Valued Quadrature Mirror Filter (cv-QMF). The output of the Discrete Fourier Transformation or time-to-frequency domain transformer in the form of a series of frequency bins or divisions can be output to the energy determiner 303.

The operation of performing the Discrete Fourier Transform is shown in FIG. 9 by step 803.

Furthermore in some embodiments the sound direction determiner 203 can be configured to comprise an energy determiner 303 or means for determining an energy spectrum for each audio signal. The energy determiner 303 can be configured to receive the output of the Discrete Fourier Transformer 301 in the form of the Fourier Domain representations and determine an input signal energy for each capture device or recording source. In some embodiments the input signal energy of each capture device or recording source can be computed according to the following equation:

$$eX_{m,l} = \sum_{bin=sbOffset[sb]}^{sbOffset[sb+1]-1} |X_m(\mathrm{bin}, l)|^2,$$

where sbOffset defines the boundaries of the frequency bands to be covered in the determination of the input signal energy determination. These bands can be, for example, linear or perceptually determined. In other words as the human auditory system operates on a pseudo logarithmic scale, non-uniform frequency bands can be used to more closely reflect the auditory sensibility with respect to the energy levels of the input signals. In some embodiments the non-uniform bands can be configured to follow the boundaries of the equivalent rectangular bandwidth (ERB) bands. The above determination can be performed or repeated for each of the number of frequency bands defined for the frame. In other words the determination can be performed in some embodiments for values of SB between 0 and nSB, where nSB is the number of frequency bands defined. In some embodiments the value of nSB can cover or define the entire frequency spectrum of the input signal, or in some other embodiments define only a portion of the input frequency spectrum. For example in some embodiments the input energy determination is performed only for lower frequency regions as these frequencies typically carry the most relevant information about the audio scene.

The operation of determining the energy values is shown in FIG. 9 by step 805.

The energy determiner 303 can be then configured to output the determined energy values to the direction determiner 305.

In some embodiments the sound direction determiner 203 can comprise a direction determiner 305 configured to receive the determined energy values of the input sources and be configured to convert these frequency domain energy values to sound direction vectors. The sound direction vectors can indicate the direction angle of the sound recorded with respect to a forward axis. Thus for a vector time index k, the perceived direction of a sound can be determined using the following expressions:

$$\text{alfa_r}_{k,ks,ke} = \frac{\sum_{m=0}^{N-1} eXX_{m,ks,ke} \cdot \cos(\phi_{m,k})}{\sum_{m=0}^{N-1} eXX_{m,ks,ke}},$$

$$\text{alfa_i}_{k,ks,ke} = \frac{\sum_{m=0}^{N-1} eXX_{m,ks,ke} \cdot \sin(\phi_{m,k})}{\sum_{m=0}^{N-1} eXX_{m,ks,ke}}$$

$$eXX_{m,ks,ke} = \frac{1}{ke - ks} \cdot \sum_{i=ks}^{ke-1} eX_{m,i}$$

where $\phi_{m,k}$ describes the recording angle (azimuth) of the $m^{th}$ capture device or recording source relative to the forward axis within the direction vector time index, N is the number of capture devices or recording sources present in the audio-visual scene, and ks and ke define the start and end indices (within the time frame index domain) for the time index k, respectively. The direction angle is then determined as follows $$\theta_k \Leftrightarrow (\text{alfa_}r_{k,dir_s(k),dir_e(k)}, \text{alfa_}i_{k,dir_s(k),dir_e(k)})$$

where dir_s(k) and dir_e(k) are functions that determine the start and end indices for the $k^{th}$ time index, respectively. In some embodiments the time index k covers time instants 0 seconds (k=0), 3 s (k=1), 6 s (k=2), 9 s (k=3), . . . till the end of recordings. The calculation window for each time index k in such embodiments is set to 8 seconds, and the values of dir_s and dir_e both cover 4 seconds preceding and following the current time index. For example, at time index k=2, the values of dir_s and dir_e are set so that they correspond to time instants 6−4=2 s and 6+4=10 s, respectively.

It would be understood that other time instant periods could also be calculated in other embodiments of the application. In some embodiments the recording angle difference with respect to the sound direction can then be determined according to the following expressions:

$$\Delta_{m,k} = \begin{cases} \alpha, & |\alpha| > |\beta| \\ \beta, & \text{otherwise} \end{cases}$$

$$\alpha = \theta_k - \phi_{m,k},$$

$$\beta = 360 - \alpha$$

The operation of determining the direction of the sound can be shown in FIG. 9 by step 807.

Figure 5:
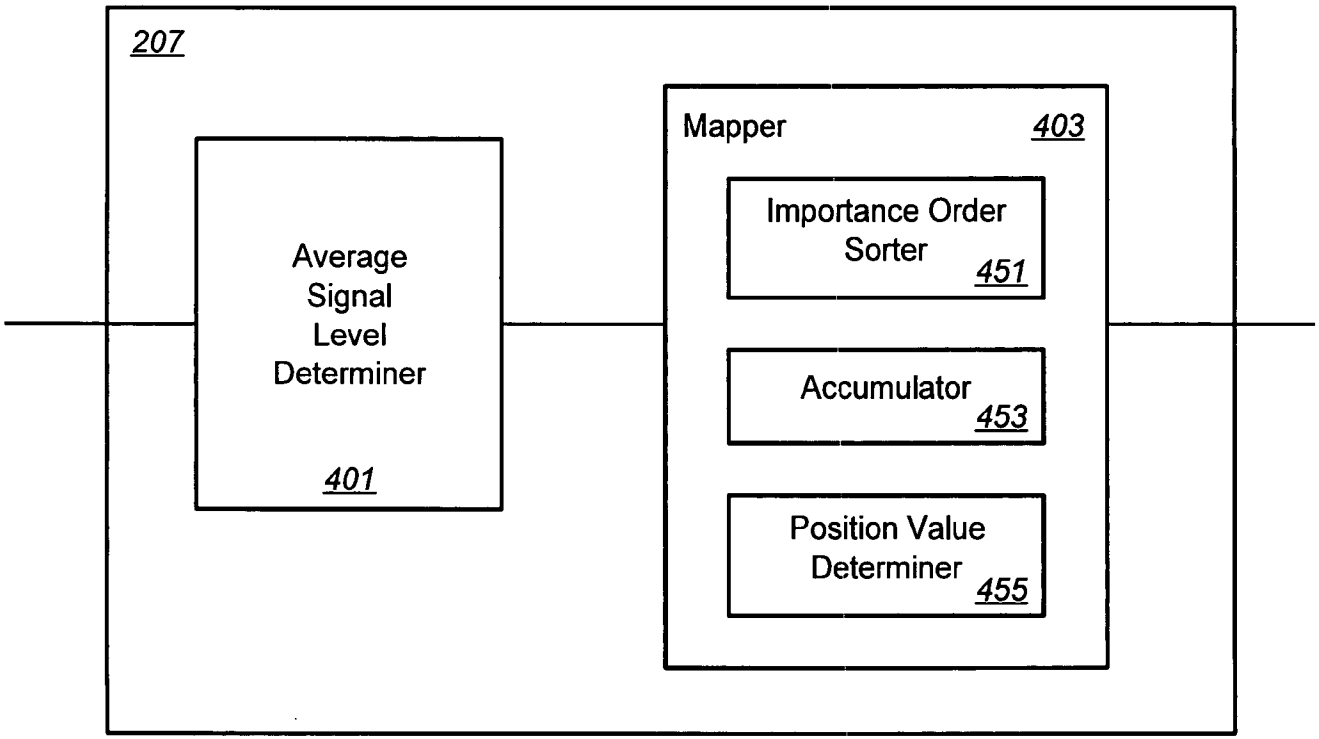
FIG. 5 shows schematically a virtual position determiner as shown in FIG. 3 according to some embodiments of the application.
Figure 10:
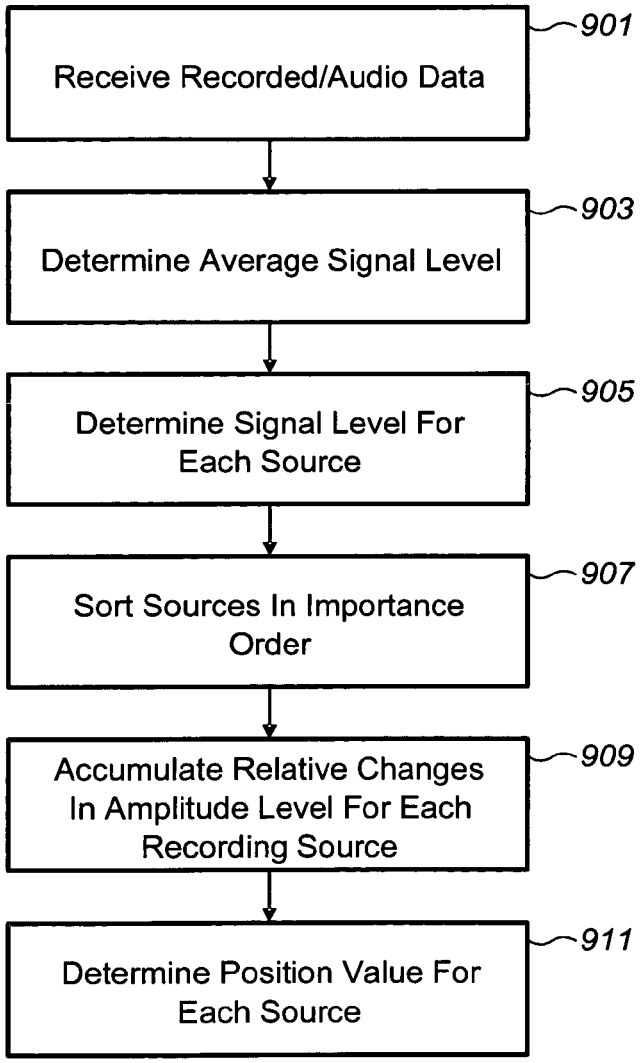
FIG. 10 shows a flow diagram of the operation of the virtual position determiner 207 as shown in FIGS. 3 and 5 according to some embodiments of the application.

With respect to FIG. 5 and FIG. 10, an example of the virtual position determiner and the operation of the virtual position determiner according to some embodiments of the application is shown in further detail.

In some embodiments the virtual position determiner 207 can be configured to comprise an average signal level determiner 401 or means for determining an average audio signal level for at least two recording apparatus. The average signal level determiner 401 can be configured to receive the recorded/audio data from each device or source.

The operation of receiving the recorded/audio data is shown in FIG. 10 by step 901.

The virtual position determiner 207 can be configured to determine the virtual position of the capture devices or recording sources present in the scene based on the audio signal that each capture device or recording source is recording. In other words as recording sources close to the sound source have in general a higher microphone signal pick-up then for the recording sources which are further from the sound source, then the virtual position can in some embodiments be determined based on this. The average signal level determiner 401 can be configured to determine the average signal level for each recording source, initially using a high temporal resolution (higher than the resolution set for the time index k but less than the resolution used in the time-to-frequency determination). This average signal level can then be converted to a positioning value on a coarser resolution mapping. The average signal level determiner 401 can in some embodiments determine the average signal level according to the following equation:

$$levelX_{m,ls(lk),le(lk)} = \frac{1}{le(lk) - ls(lk)} \cdot \sum_{i=ls(lk)}^{le(lk)-1} \left( \frac{1}{N} \cdot \sum_{n=0}^{N-1} |x_m(n + i \cdot T)| \right)$$

where ls(k) and le(k) are functions that determine the start and end indices (within the time frame index domain) for the $lk^{th}$ intermediate level index, respectively. In an example implementation, the intermediate level index lk covers time instants 0 milliseconds (lk=0), 200 ms (lk=1), 400 ms (lk=2), 600 ms (lk=3), . . . till the end of recordings. The calculation window for each intermediate level index lk can in this example be set to 2.5 seconds, and the values of ls and le both cover 1.25 seconds preceding and following the current intermediate level index. For example, at intermediate level index lk=10 (1800 ms), the values of ls and le can in some embodiments be set so that they correspond to time instants 1800−1250=550 ms and 1800+1250=3050 ms, respectively.

The output of the average signal level determiner can be passed to a mapper 403.

The determination of the average signal level can be shown in FIG. 10 by step 903.

In some embodiments the virtual position determiner 207 can be configured to comprise a mapper 403 or means for mapping each of the at least audio signal to a relative distance. The mapper 403 can be configured to receive the average signal level value and map the average signal level value to a relative position distance. The mapper 403 on receiving the average signal level determinations from the average signal level determiner 401 can be configured to determine the signal level for each source. This, for example can be carried out according to the following equation:

$$lX(m) = \text{level}X_{m,ls(lk),le(lk)}, 0 \le m < N$$

The operation of determining the signal level for each source is shown in FIG. 10 by step 905.

Furthermore in some embodiments the mapper 403 can comprise an importance order sorter 451. The importance order sorter 451 can be configured to sort the signal levels for each recording source into a decreasing order of importance. Thus, for example where slX represents the sorted vector and slX_ldx represents the corresponding index in lX. The sorted importance order values can then be passed to an accumulator 453.

The sorting of the sources in order of importance is shown in FIG. 10 by step 907.

In some embodiments the mapper 403 can comprise an accumulator 453. The accumulator 453 can be configured to receive the sorted signal level values and accumulate the relative changes in the amplitude level for each recording source.

For example the accumulator 453 can in some embodiments carry out the following expressions to the sorted amplitude levels:

$$tSig_{mx}(lk) = tSig_{mx}(lk) + \frac{slX(mx)}{slX(0)},$$

$$0 \le m < N$$

$$mx = \text{slX_Idx}(m)$$

where the value of tSig is initialized to zero at start-up.

The output of the accumulator values can then be passed to a position value determiner 455.

The operation of accumulating the relative changes in amplitude level for each recording source is shown in FIG. 10 by step 909.

In some embodiments the mapper 403 can comprise a position value determiner 455. The position value determiner 455 can be configured to receive the accumulated relative change values produced by the accumulator 453 and determine the virtual position value for each recording source. In some embodiments the position value determiner 455 can be configured to produce such a determination using the following equation:

$$tDistance_m(k) = \frac{1}{te(tk) - ts(tk)} \cdot \sum_{i=ts(tk)}^{te(tk)-1} tSig_m(tk)$$

where ts(k) and te(k) are functions that determine the start and end indices for the $tk^{th}$ level index, respectively. In the example implementation, the level index tk covers the same time instants as time index k discussed herein. The calculation window for each level index tk is thus in some embodiments set to 8 seconds, and the values of ts and te both cover the 4 seconds preceding and following the current intermediate index. For example, at intermediate level index tk=2 (6 s), the values of ts and te are set so that they correspond to time instants 6−4=2 s and 6+4=10 s, respectively.

The operation of determining the position value for each source can be shown in FIG. 10 by step 911.

Figure 6:
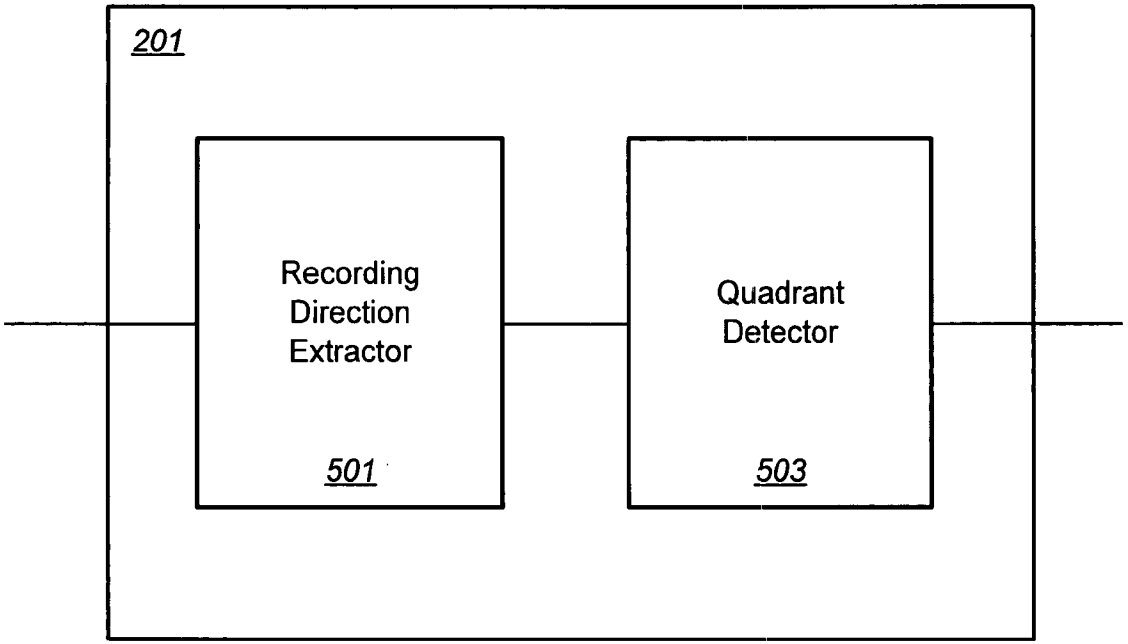
FIG. 6 shows schematically a recording direction determiner according to some embodiments of the application.
Figure 11:
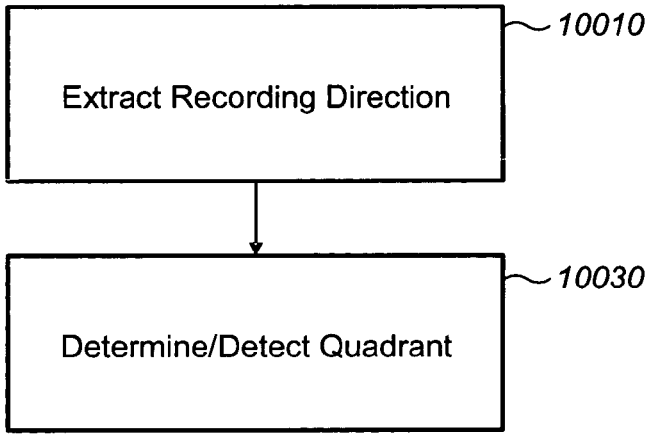
FIG. 11 shows a flow diagram of the operation of the recording direction determiner as shown in FIGS. 3 and 6 according to some embodiments of the application.

With respect to FIG. 6 and FIG. 11, the recording direction determiner according to some embodiments is shown in further detail.

In some embodiments the recording direction determiner 201 can be configured to receive the sensory information from the audio sources. The sensory information from the audio sources can then be analysed. In some embodiments the recording direction determiner 201 can thus comprise a recording direction extractor 501. The recording direction extractor 501 can be configured to receive, for example, stored compass sensor data to extract the recording direction at the given time. For example the recording direction extractor 501 can be configured to calculate the recording direction for the time index k according to the following expression:

$$\phi_{m,k} = \frac{1}{ke(k) - ks(k)} \cdot \sum_{i=ks(k)}^{ke(k)-1} \theta_{m,i}$$

$$\theta_{m,i} = \begin{cases} y\phi_{m,i}, & q14_m == \text{True} \\ x\phi_{m,i}, & \text{otherwise} \end{cases}$$

$$y\phi_{m,i} = \begin{cases} (180 - x\phi_{m,i}) + 360, & x\phi_{m,i} > 180 \\ 180 - x\phi_{m,i}, & \text{otherwise} \end{cases}$$

where $x\phi_{m,i}$ describes the compass angle value for the $m^{th}$ recording source at time frame index i. The variable q14 is used to indicate whether the compass angle values cover both in the $1^{st}$ and $4^{th}$ quadrant as shown in FIG. 5. If compass angle values covering indices between ks(k) and ke(k) are found to be present in $x\phi_{m,i}$, $q14_m$ is set to True, otherwise it is set to False. The quadrant detection is needed in order to obtain correct recording angle for the time index as the angle is calculated as the mean of the compass angle values in the current implementation. The variable $q14_m$ is used in some embodiments to temporarily shift the compass angle values from the $1^{st}$ and $4^{th}$ quadrant in order the mean calculation produces the correct results (as the mean angle between the $1^{st}$ and $4^{th}$ quadrant is 0°/360° instead of 180°). After obtaining the mean angle value for the recording source, the shift in the angle value is removed according to $$\phi_{m,k} = \begin{cases} (180 - \phi_{m,k}) + 360, & \phi_{m,k} > 180 \\ 180 - \phi_{m,k}, & \text{otherwise} \end{cases}$$

The above equation is computed when $q14_m$ is set to value True. The recording angle in some embodiments can be obtained also using median value (in which case no quadrant detection is needed), and/or a combination of mean and median, combination of weighted mean and median, or histogram analysis (that is in such embodiments the recording angle, within certain angle variations, that appears most gets selected).

The output of the recording direction extractor 501 can then be passed to the quadrant detector 503.

The operation of extracting the recording direction is shown in FIG. 11 by step 10010.

Figure 13:
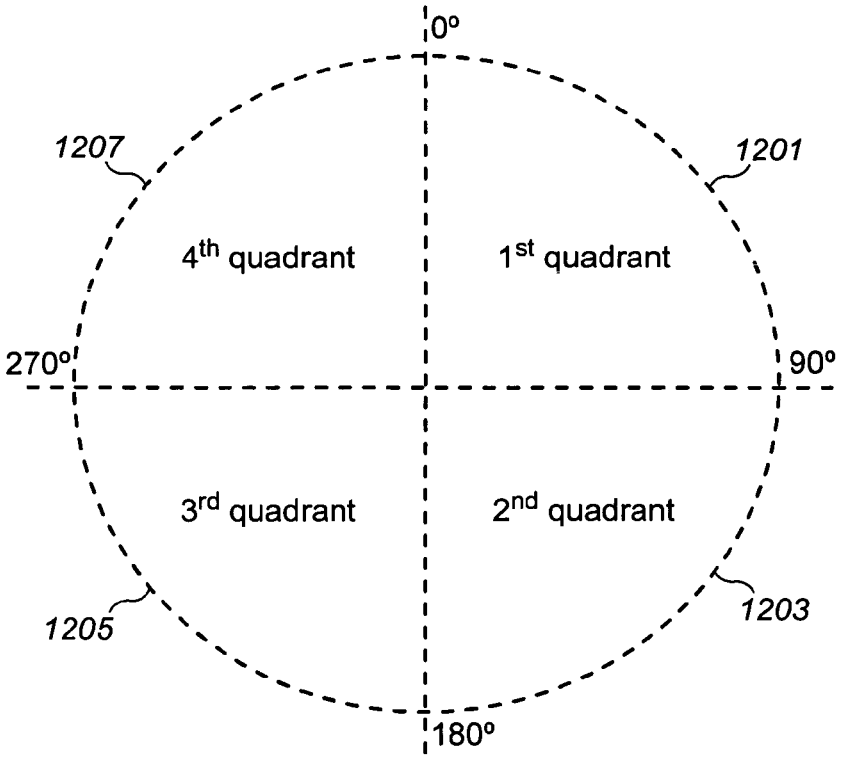
FIG. 13 shows the quadrant division according to some embodiments of the application.

Furthermore the quadrant detector 503 can be configured to receive the output of the recording direction extractor 501 and further determine whether the angle value covers which quadrant. For example as shown in FIG. 13, the first 1201, second 1203, third 1205 and fourth 1207 quadrants are shown in a clockwise progression from "ahead" 0°, 90° and 270°.

The determination or detection of the quadrant operation is shown in step 10030 in FIG. 11.

Figure 7:
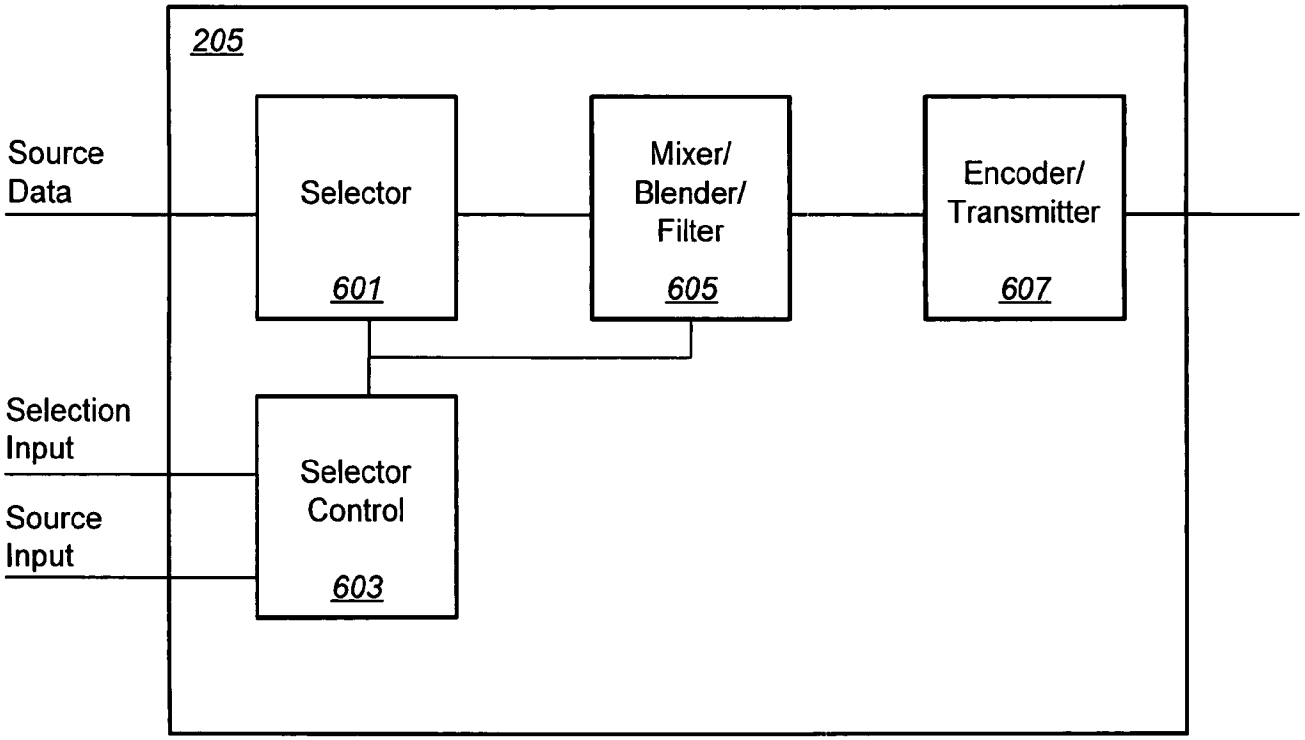
FIG. 7 shows a down mixer as shown in FIG. 3 according to some embodiments of the application.

With respect to FIG. 7 the down mixer 205 is shown in further detail. Furthermore with respect to FIG. 12 the operation of such a down mixer according to some embodiments is shown also.

The down mixer 205 can be configured to select and down mix the audio data or source data dependent on the selected input and the source input or map of shooters information for various time indexes. In some embodiments as described herein, this "map of shooters" information can comprise at least one of:

tDistance—position in value of each recording source:

The tDistance variable describes the positioning value for each capture device or recording source recording to the output of the virtual position determiner 207. The positioning value varies between values of 0 and 1, where a value of 1 can indicate that the recording source is closest to the sound source and values below 1 indicate that the recording source is further away from the assumed sound source.

azimuth—recording angle of each recording source:

The azimuth variable describes the recording angle for each capture device or recording source. The recording angles are determined, for example by the recording direction determiner 201. The recording angle can then in some embodiments be used as an indicator in the composite mixture, where a recording angle is configured to control the composition of the down mixed signal.

direction—sound direction in the audio scene:

The direction variable describes the direction of the sound in the audio scene. The direction angle is determined according to the output of the sound direction determiner 203. The direction angle can be used as an indicator in the composite mixture where the sound direction is configured to control the down mixed signal mixture.

diffDir—recording angle difference:

The diffDir variable describes the recording angle difference with respect to the sound direction for each capture device or recording source according to the output of the sound direction determiner 203. The difference angles can be used in some embodiments to track the recording sources that more closely follow the sound sources.

In some embodiments, this information together with a selection input can be received by a selection controller 603. The selection controller 603 can be configured to, based on the various information control the selection of source data or audio data and further control the mixture or blending or filtering of the selected audio sources. Any suitable selection control apparatus can be used, for example in some embodiments a minimum error between the selected estimate and the source input variables can be used to select the closest or minimal closely matching sources.

Figure 12:
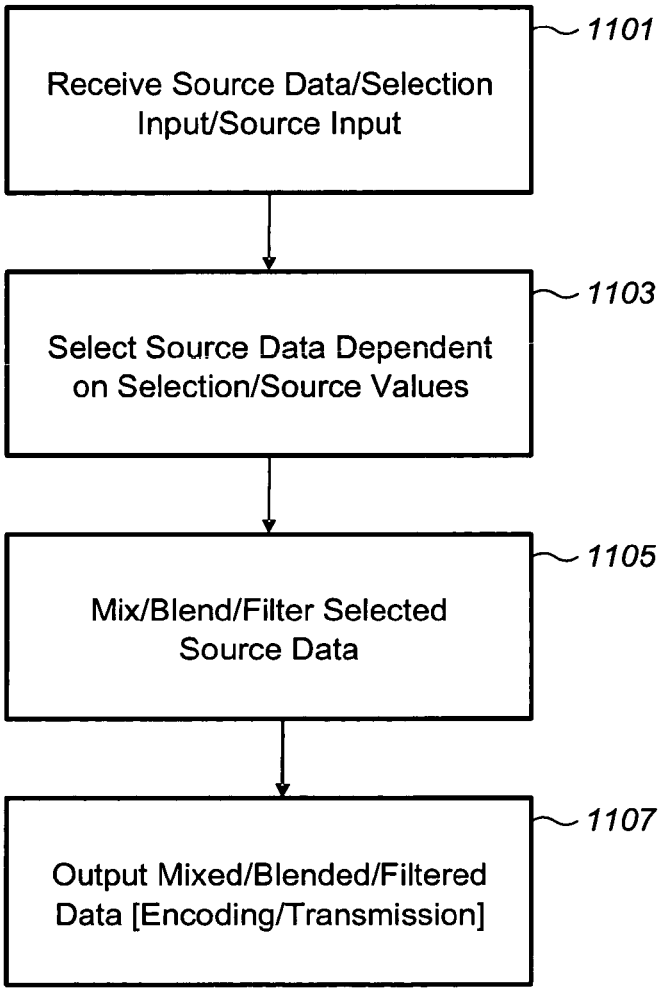
FIG. 12 shows a flow diagram of the operation of the down mixer as seen in FIGS. 3 and 7 according to some embodiments of the application.

The operation of receiving the source data/selection input data and source input can be seen in FIG. 12 by step 1101.

In some embodiments the down mixer 205 comprises a selector 601 or means for selecting at least one of the at least one audio signal or sources. The selector 601 can comprise a series of switches configured to output at least one source data input to a mixer/blender/filter 605 or means for filtering/mixing/blending each of the at least one of the at least one audio signals selected, dependent on the input provided from the selector control 603.

The selection of source data dependent on the selection/source values can be seen in FIG. 12 by step 1103.

Furthermore in some embodiments the down mixer comprises a mixer/blender/filter 605 configured to receive the selected source data output by the selector 601 and furthermore the selector control 603 information with regards to controlling the operation of mixing, blending or filtering the selector output source data streams. Any suitable mixing/blending or filtering operation can be employed in some embodiments of the application. The operation of mixing/blending/filtering the selected source data is shown in FIG. 12 by step 1105. The output of the mixer/blender/filter 605 can be passed to an encoder or transmitter 607.

In some embodiments the encoder/transmitter 607 can be configured to receive the mixed audio signal and output the mixed/blended/filtered data to the end user or listening device 113 via the network transmission channel 111. Thus in some embodiments the encoder/transmitter 607 can be configured to encode or modify the output audio stream to be suitable for transmission to the listening device 113.

The map-of-shooters information can in some embodiments be used with the selection controller 603 to control the selection of capture device or recording sources for mixing/blending/filtering in the downmix signal(s) selection process according to following principles:

1. Change Listening/Viewing Angle, Maintain Distance:

In this selection mode, the selection controller receives information indicating that the listening/viewing angle from a sound source is changed at certain time intervals (which may be constant or arbitrary) but the positioning distance is kept the same, as far as possible. The angle can for example be changed from 45° to 135° but the positioning distance with the new angle is kept the same. The change in the angle value may be based on the recording angle, direction angle or recording angle difference.

2. Change Distance, Maintain Listening/Viewing Angle:

In this selection mode, the selection controller receives information indicating that the positioning distance from a sound source is changed while the listening/viewing angle stays the same. The positioning distance in this example can be changed, for example, from distance of 0.91 to less than that so that the distance to the sound source is greater than what is was previously. In some embodiment the listening/viewing angle is not necessarily exactly the same as the previously indicated or desired angle but can be within a defined threshold, for example, within 10°, 20°, 30° or within the same quadrant.

3. Change Distance and Listening/Viewing Angle:

In this selection mode the selection controller receives information indicating that both the positioning distance and the listening/viewing angle are to be changed.

4. (Arbitrary) Combination of the Above:

In this selection mode, the selection controller receives information indicating that any combinations of the changes described herein are to be used in the selection process for the downmixed signal(s).

As an illustrative example, the table 1 contains map-of-shooters information for 3 different time instants. The time instants used 0, 1, 2 are illustrative only and any suitable instant period can be used. The time instants for example can represent in some embodiments constant intervals or they can be based on irregular intervals. The selection controller can in such an example select signal composition with different selection modes such as:

Example Mode

1. Distance of 0.9 or Greater is to be Maintained, while Scanning the Listening/Viewing Angles:

For the time instant 0, recording source 4 at recording angle 17° is first selected. For time instant 1, the recording source is changed to source 1 at recording angle 319°, the distance is slightly below the 0.9 threshold but it is the only recording source at the given recording angle so it gets selected. For time instant 2, the recording source is changed to source 3 and the recording angle is 118°.

Example Mode

2. Maintain Listening/Viewing Angle Difference at Maximum 45° while Distance is Freely Allowed to Change:

For the time instant 0, recording source 0 is first selected. For time instant 1, the recording source is changed to 4 as the recording angle for this source is within the 45° difference.

For time instant 2, the recording source is changed either to 0 or 1 as the recording angle difference with respect to the starting angle is less than 45° difference.

TABLE 1

| Time instant | Recording source index | tDistance | $\phi_{m,k}$ | $\theta_k$ | $\Delta_{m,k}$ |
|---|---|---|---|---|---|
| 0 | 0 | 0.790983 | 0 | 29 | −28 |
| | 1 | 0.908615 | 318 | 29 | −71 |
| | 2 | 0.684939 | 85 | 29 | 56 |
| | 3 | 0.869253 | 119 | 29 | 89 |
| | 4 | 0.980899 | 17 | 29 | −11 |
| 1 | 0 | 0.816152 | 0 | 33 | −32 |
| | 1 | 0.898264 | 319 | 33 | −74 |
| | 2 | 0.708678 | 141 | 33 | 107 |
| | 3 | 0.872649 | 118 | 33 | 84 |
| | 4 | 0.997981 | 19 | 33 | −13 |
| 2 | 0 | 0.799266 | 0 | 13 | −12 |
| | 1 | 0.890542 | 323 | 13 | −50 |
| | 2 | 0.702039 | 204 | 13 | −169 |
| | 3 | 0.860678 | 118 | 13 | 104 |
| | 4 | 0.998136 | 22 | 13 | 9 |

The map-of-shooters information in some embodiments can further provide/use with the following information:

isROI—Region-of-Interest:

The isROI variable can in some embodiments describe whether the recording source follows the region of interest in terms of the recording angle. This value can then be used in the selection controller in some embodiments to control whether the recording source at the particular time index is following the audio scene consistently. The region of interest flag can in some embodiments be determined by calculating the variance of the recording angle within the time index and if recording angle value varies significantly then the capture device or recording source can be determined not to be following the audio scene at that particular time index. For example, the user of the capture device can be determined not to be recording the audio scene but is doing something else that distracts from recording. The variation in the recording angle value can in some embodiments be calculated according to $$\chi_{m,k} = \sqrt{\frac{1}{ke(k) - ks(k) - 1} \cdot \sum_{i=ks(k)}^{ke(k)-1} (\theta_{m,i} - \phi_{m,k})^2}$$

In some embodiments when the variance for the $m^{th}$ recording source at time index k exceeds some threshold, for example 45°, the isROI variable can be set to False, otherwise the isROI value it is set to True. In the selection process, the selection controller can be configured in some embodiments to examine the isROI value and for recording sources that have isROI set to value True avoid selecting the audio signal associated with the capture device or recording source as the device/source may not contain interesting content for the end user.

recPos—Positioning code for each recording source:

The recPos variable can be configured in some embodiments to describe the positioning value in a coarser scale for each recording source. For example, in some embodiments only 3 positions are given for each recording source; Close, Medium, and Far. The Close position can indicate that the recording source is close to the sound source, the Medium position can indicate that the recording source is at a "medium" distance from the sound source, and the Far position can indicate that the recording source is at a "far" distance from the sound source. The assignment to limited number of positions can be done according to the following expressions:

$$tMean = \frac{1}{N \cdot TK} \cdot \sum_{m=0}^{N-1} \left( \sum_{k=0}^{TK-1} tDistance_m(tk) \right)$$

$$tStd = \sqrt{\frac{1}{N \cdot TK - 1} \cdot \sum_{m=0}^{N-1} \left( \sum_{k=0}^{TK-1} (tDistance_m(tk) - tMean)^2 \right)}$$

where TK is the number of level indices tk. The recPos values can thus be in some embodiments determined using the following pseudo-code which assigns the positioning codes for each recording source according to Pseudo-Code 1:

```
For m = 0 to N
  recPosID_m(k) = N_ID_POS−1;

tmp = 1.0f − tStd;
For posID = 0 to N_ID_POS−1
{
  For m = 0 to N−1
    if(tDistance_m(k) >= tmp && idxTxt[m] == N_ID_POS−1)
      recPosID_m(k) = idx;

  tmp −= tStd;
}
```

The above pseudo-code can in some embodiments be repeated for 0≤k<TK and N_ID_POS is the number is positioning codes being used (set to 3 in our example). The variance of the distance positions over all time indices is thus in some embodiments calculated first. The variance is then used in such embodiments as a threshold value when assigning the positioning codes for each recording source (such as shown in pseudo-code 1). The positioning code in such embodiments can be configured to map distance positions within the threshold as defined by the variance into one positioning code. This mapping can in some embodiments serve as a basis for the downmix signal(s) selection by the selection controller. Although 3 codes are defined it can be understood that more than 3 codes can be defined. Furthermore in some embodiments the selection controller can define a selection pattern to follow some pre-defined pattern such as Close, Medium, Far, Far, Medium, Close; or Close, Far, Close, Medium, Close, Far, Medium, Close.

Although the above has been described with regards to audio signals, or audio-visual signals it would be appreciated that embodiments may also be applied to audio-video signals where the audio signal components of the recorded data are processed in terms of the determining of the base signal and the determination of the time alignment factors for the remaining signals and the video signal components may be synchronised using the above embodiments of the invention. In other words the video parts may be synchronised using the audio synchronisation information.

It shall be appreciated that the term user equipment is intended to cover any suitable type of wireless user equipment, such as mobile telephones, portable data processing devices or portable web browsers.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. Apparatus comprising at least one processor and at least one memory including computer code for one or more programs, the at least one memory and the computer code configured to with the at least one processor cause the apparatus to at least:

receive at least one audio signal from a recording apparatus;

receive at least one orientation indicator from the recording apparatus, each orientation indicator associated with the at least one audio signal;

determine a direction of the recording apparatus dependent on the each orientation indicator associated with the one at least audio signal;

determine a sound direction vector for a sound recorded by the recording apparatus, wherein the sound direction vector is dependent on an energy spectrum for the at least one audio signal from the recording apparatus and the at least one orientation indicator received from the recording apparatus; and determine a virtual position of the recording apparatus from a sound source by the apparatus being caused to determine an average audio signal level of the at least one audio signal from the recording apparatus and at least one further audio signal from a further recording apparatus, and map the at least one audio signal to a relative distance dependent on a signal level of the at least one audio signal compared against the average audio signal level.

2. The apparatus as claimed in claim 1, wherein the at least one orientation indicator comprises at least one of:

a compass indicator signal;

a gyroscope indicator signal; and a satellite position indicator signal.

3. The apparatus as claimed in claim 1, further caused to select at least one of the at least one audio signal dependent on at least one of:

the direction of the recording apparatus;

the sound direction vector for the sound recorded by the recording apparatus; and the virtual position of the recording apparatus.

4. The apparatus as claimed in claim 3, further caused to process each of the at least one of the at least one audio signal selected dependent on at least one of:

the direction of the recording apparatus;

the sound direction vector for the sound recorded by the recording apparatus; and the virtual position of the recording apparatus.

5. The apparatus as claimed in claim 3, wherein processing each of the at least one of the at least one audio signal selected further causes the apparatus to at least one of:

filter each of the at least one of the at least one audio signal selected;

mix each of the at least one of the at least one audio signal selected; and blend each of the at least one of the at least one audio signal selected.

6. The apparatus as claimed in claim 3, further caused to output each of the at least one selected audio signal to a further apparatus.

7. The apparatus as claimed in claim 3, further caused to:

receive a selection indicator from a further apparatus; and wherein selecting at least one of the at least one audio signal is further dependent on the selection indicator.

8. A method comprising:

receiving at least one audio signal from a recording apparatus;

receiving at least one orientation indicator from the recording apparatus, each orientation indicator associated with the at least one audio signal;

determining a direction of the recording apparatus dependent on the each orientation indicator associated with the one at least audio signal;

determining a sound direction vector for a sound recorded by the recording apparatus, wherein the sound direction vector is dependent on an energy spectrum for the at least one audio signal from the recording apparatus and the at least one orientation indicator received from the recording apparatus; and determining a virtual position of the recording apparatus from a sound source by the apparatus being caused to determine an average audio signal level of the at least one audio signal from the recording apparatus and at least one further audio signal from a further recording apparatus, and map the at least one audio signal to a relative distance dependent on a signal level of the at least one audio signal compared against the average audio signal level.

9. The method as claimed in claim 8, wherein the at least one orientation indicator comprises at least one of:

a compass indicator signal;

a gyroscope indicator signal; and a satellite position indicator signal.

10. The method as claimed in claim 8, further comprising selecting at least one of the at least one audio signal dependent on at least one of:

the direction of the recording apparatus;

the sound direction vector for the sound recorded by the recording apparatus; and the virtual position of the recording apparatus.

11. The method as claimed in claim 10, further comprising processing each of the at least one of the at least one audio signal selected dependent on at least one of:

the direction of the recording apparatus;

the sound direction vector for the sound recorded by the recording apparatus; and the virtual position of the recording apparatus.

12. The method as claimed in claim 10, wherein processing each of the at least one of the at least one audio signal selected comprises at least one of:

filtering each of the at least one of the at least one audio signal selected;

mixing each of the at least one of the at least one audio signal selected; and blending each of the at least one of the at least one audio signal selected.

13. The method as claimed in claim 10, further comprising outputting each of the at least one selected audio signal to a further apparatus.

14. The method as claimed in claim 10, further comprising:

receiving a selection indicator from a further apparatus; and wherein selecting at least one of the at least one audio signal is further dependent on the selection indicator.

15. A computer program product comprising a non-transitory computer-readable medium bearing computer program code embodied therein, the computer program code configured to cause an apparatus at least to perform:

receiving at least one audio signal from a recording apparatus;

receiving at least one orientation indicator from the recording apparatus, each orientation indicator associated with the at least one audio signal;

determining a direction of the recording apparatus dependent on the each orientation indicator associated with the one at least audio signal;

determining a sound direction vector for a sound recorded by the recording apparatus, wherein the sound direction vector is dependent on an energy spectrum for the at least one audio signal from the recording apparatus and the at least one orientation indicator received from the recording apparatus; and determining a virtual position of the recording apparatus from a sound source by the apparatus being caused to determine an average audio signal level of the at least one audio signal from the recording apparatus and at least one further audio signal from a further recording apparatus, and map the at least one audio signal to a relative distance dependent on a signal level of the at least one audio signal compared against the average audio signal.

16. The computer program product as claimed in claim 15, wherein the at least one orientation indicator comprises at least one of:

a compass indicator signal;

a gyroscope indicator signal; and a satellite position indicator signal.

17. The computer program product as claimed in claim 15, the computer program code configured to further cause the apparatus at least to perform:

selecting at least one of the at least one audio signal dependent on at least one of:

the direction of the recording apparatus;

the sound direction vector for the sound recorded by the recording apparatus; and the virtual position of the recording apparatus.

18. The computer program product as claimed in claim 17, the computer program code configured to further cause the apparatus at least to perform:

processing each of the at least one of the at least one audio signal selected dependent on at least one of:

the direction of the recording apparatus;

the sound direction vector for the sound recorded by the recording apparatus; and the virtual position of the recording apparatus.

* * * * *